US009487719B2

(12) United States Patent
Arters et al.

(10) Patent No.: US 9,487,719 B2
(45) Date of Patent: Nov. 8, 2016

(54) METHODS AND COMPOSITIONS THAT PROVIDE DETERGENCY

(75) Inventors: David C. Arters, Solon, OH (US); Robert H. Barbour, Ashbourne (GB)

(73) Assignee: The Lubrizol Corporation, Wickliffe, OH (US)

( * ) Notice: Subject to any disclaimer, the term of this patent is extended or adjusted under 35 U.S.C. 154(b) by 412 days.

(21) Appl. No.: 13/696,827

(22) PCT Filed: May 11, 2011

(86) PCT No.: PCT/US2011/035999

§ 371 (c)(1),
(2), (4) Date: Jan. 16, 2013

(87) PCT Pub. No.: WO2011/146289

PCT Pub. Date: Nov. 24, 2011

(65) Prior Publication Data

US 2013/0192124 A1 Aug. 1, 2013

Related U.S. Application Data

(60) Provisional application No. 61/345,684, filed on May 18, 2010.

(51) Int. Cl.

| | |
|---|---|
| ***C10L 1/188*** | (2006.01) |
| ***C10L 1/198*** | (2006.01) |
| ***C10L 10/02*** | (2006.01) |
| ***C10L 10/04*** | (2006.01) |
| ***C10L 10/18*** | (2006.01) |

(52) U.S. Cl.

CPC ..... *C10L 1/1883* (2013.01); *C10L 1/188* (2013.01); *C10L 1/198* (2013.01); *C10L 10/02* (2013.01); *C10L 10/04* (2013.01); *C10L 10/18* (2013.01)

(58) Field of Classification Search

USPC ..... 44/307, 385, 403

See application file for complete search history.

(56) References Cited

U.S. PATENT DOCUMENTS

| | | | | |
|---|---|---|---|---|
| 3,346,354 | A | 10/1967 | Kautsky et al. | |
| 6,361,573 | B1 * | 3/2002 | Henly | 44/335 |
| 2008/0034647 | A1 * | 2/2008 | Cunningham et al. | 44/412 |
| 2008/0282607 | A1 * | 11/2008 | Dietz et al. | 44/387 |
| 2009/0149358 | A1 | 6/2009 | Rhoads et al. | |
| 2009/0307967 | A1 | 12/2009 | Gardener et al. | |

FOREIGN PATENT DOCUMENTS

| | | |
|---|---|---|
| EP | 0280417 | 8/1988 |
| EP | 0874039 | 10/1998 |
| JP | 2009-292934 A | 12/2009 |
| WO | 00/58422 A1 | 10/2000 |
| WO | 2008/116552 | 10/2008 |
| WO | 2010/042378 | 4/2010 |

OTHER PUBLICATIONS

Corresponding PCT Publication No. WO 2011/146289 A1 & Search Report published Nov. 24, 2011.
Written Opinion from corresponding International Application No. PCT/US2011/035999 dated Aug. 11, 2011.

* cited by examiner

*Primary Examiner* — Prem C Singh
*Assistant Examiner* — Chantel Graham
(74) *Attorney, Agent, or Firm* — Iken S. Sans; Christopher D. Hilker; Teresan W. Gilbert

(57) ABSTRACT

The present invention relates to methods of fueling an internal combustion engine, and composition, that provide improved nitrogen-free detergency in the engine, particularly in the area of injector deposit control. The present invention also provides methods of providing both improved detergency and improved corrosion inhibition, while avoiding compatibility problems with fuels and/or while limiting the amount of nitrogen delivered to the fuel from the deposit control additive.

9 Claims, No Drawings

METHODS AND COMPOSITIONS THAT PROVIDE DETERGENCY

BACKGROUND OF THE INVENTION

The present invention relates to methods of fueling an internal combustion engine, specifically a direct injection diesel engine, providing improved nitrogen-free detergency in the engine, particularly in the area of injector deposit control. The present invention also provides methods of providing both improved detergency and improved corrosion inhibition, while avoiding compatibility problems with fuels and/or while limiting the amount of nitrogen delivered to the fuel from the deposit control additive.

Hydrocarbon-based fuels generally contain numerous deposit-forming substances. When used in internal combustion engines (ICE), deposits from these substances can form on and around constricted areas of the engine which come in contact with the fuel. In these ICE, such as automobile engines, deposits can build on engine intake valves and/or fuel injectors leading to progressive restriction of the flow of the fuel mixture into the combustion chamber, in turn reducing the maximum power of the engine, decreasing fuel economy, increasing engine emissions, hindering engine startability, and/or affecting overall drivability.

Engines have and continue to become more sensitive to deposits due at least in part to engine designs utilizing tighter clearances with more constricted areas. A common practice is to incorporate a detergent into the fuel composition for the purpose of reducing or inhibiting the formation of, and facilitating the removal of, engine deposits. These additives improve the engine performance and reduce the engine emissions.

Generally, fuel detergent additives include additives that can be described as ashless dispersants. These additives consist of hydrocarbyl backbones, including polyisobutylene (PIB) backbones, which traditionally have been combined with polar, nitrogen-containing head groups. The primary fuel detergent additives used today include PIB amines, PIB succinimides and PIB phenol Mannich amines. One key aspect of these fuel detergent additives is the presence of an active nitrogen-containing group, which is believed to be required for good performance of the additives.

In some cases, nitrogen-containing additives can lead to undesirable effects, such as seal degradation, particularly in the case of fluoro-elastomer containing seals. Nitrogen-free additives would be free of these potential disadvantages.

There is a need for an effective fuel additive that may be used in fuel additive compositions and fuel compositions in the operation of ICEs that is free of nitrogen. There is need for such nitrogen-free additives that provide comparable and/or improved performance compared to the nitrogen-containing additives commonly used today. There is also a need for these additives to provide improved corrosion inhibition and/or to avoid compatibility issues with the fuels with which they are used. Some of these compatibility issues can lead to unwanted reactions between the fuel and/or one or more additives in the fuel, resulting in byproducts that can hinder engine performance, form deposits and even plug filters. There is a need for additives and fuels compositions, as well as methods of using them, that address one or more of these problems.

SUMMARY OF THE INVENTION

The present invention provides a method of providing improved detergency in the fuel system of an internal combustion engine wherein the method comprises the steps of: (i) adding to the fuel composition a nitrogen-free additive comprising a substituted hydrocarbon with at least two carboxy functionalities in the form of acids or at least one carboxy functionality in the form an anhydride; and (ii) supplying said fuel composition to an internal combustion engine. The methods of the invention may also provide a combination of improved detergency and improved corrosion inhibition. The invention accomplishes these objectives while also limiting the amount of nitrogen delivered to the fuel from the deposit control additive, to the point of being a nitrogen-free additive, and also avoiding fuel compatibility issues, particularly when significant amounts of metals, such as sodium, are present in the fuel compositions.

The invention also provides the fuel composition used in the methods above themselves as well as the fuel additive compositions that could be used in the preparation of such fuels.

The invention also provides the use of the additives described herein to control and/or reduce deposits in engines, particularly injector deposits in diesel engine. These uses also provide improved corrosion inhibition and may also limit the amount of nitrogen delivered to the fuel from the deposit control additive and/or avoid fuel compatibility issues.

DETAILED DESCRIPTION OF THE INVENTION

Various preferred features and embodiments will be described below by way of non-limiting illustration.

Field of the Invention

The present invention involves a method for fueling an internal combustion engine, and more specifically direct injection diesel engines. The invention also described the fuel compositions, the fuel additive compositions and fuel additives themselves utilized in said methods. The method involves improved deposit control in the engines in which they are used and may also improve corrosion inhibition. In some embodiments the deposit control additive is free of nitrogen and the resulting fuel compositions and fuel additive compositions may contain limited amounts of nitrogen, or in some embodiments limited amounts of basic nitrogen and/or amine nitrogen.

The fuel compositions of the invention shows comparable and/or improved engine deposit control, allowing for improved engine performance, including but not limited to reductions in deposit-caused engine power losses, reduction in deposit-caused fuel economy losses and decreases in deposit-caused engine emissions, compared to conventional, nitrogen-containing additive-based fuel compositions.

The engines suitable for use in the current invention generally include all internal combustion engines. However the methods of the present invention provide particular benefit in diesel engines, and more specifically, direct injection engines. In some embodiments the engine of the present invention are high pressure direct injection diesel engines and in still other embodiments the engine is a common rail engine. The term high pressure as used herein with regards to the engine refers to the fuel injector pressure of the engine. In some embodiments a high pressure engine means the fuel injectors operate at pressures of 20 MPa or higher, 30 MPa and higher, 35 MPa and higher, 40 MPa or higher, or even 50 MPa and higher, wherein these minimum pressure values may with regards to idle pressure or maximum pressure.

The Methods

The present invention provides methods of improving deposit control in an engine, and optionally also improved corrosion inhibition. The methods involve operating an internal combustion engine by supplying to that engine a fuel composition where the fuel composition includes the nitrogen free deposit control additive described herein.

The internal combustion engines in which the methods of the invention may be used are not overly limited and include spark ignition and compression ignition engines; and 2-stroke or 4-stroke cycle engines. The methods may also utilize engines where liquid fuel is supplied via direct injection, indirect injection, port injection or via a carburetor as well as engines with common rail and unit injector systems. Suitable engines include light (e.g. passenger car) and heavy duty (e.g. commercial truck) engines as well as engines fuelled with hydrocarbon and non-hydrocarbon fuels and mixtures thereof. The engines may include integrated emissions systems incorporating such elements as: EGR systems; aftertreatment including three-way catalyst, oxidation catalyst, NOx absorbers and catalysts, catalyzed and non-catalyzed particulate traps optionally employing fuel-borne catalyst; variable valve timing; injection timing and rate shaping; and combinations thereof. In some embodiments the engines suitable in the methods of the present invention are direct injection engines, and in some embodiments common rail direct injection engines. In some embodiments the engines of the methods are not indirect injection engines.

The present invention includes the use of the substituted hydrocarbon and/or hydrocarbyl substituted acylating agents described herein as additives in fuel compositions, as well as the additive itself and the fuel and fuel additive compositions containing said additive. The additives of the present invention may be delivered to the fuel compositions and/or fuel additive compositions in any of the means known in the art and the timing of the additive is not limited. In other words, the additive of the present invention may be added to a fuel composition before, during, or after the production and/or blending of the fuel and/or additive composition. The additive of the invention may be added to fuel and/or additive composition before, during, or after the addition of other performance additives which may be used in the compositions. The additive of the invention may be added as a top treat to fuel and/or additive compositions or be incorporated into the production and/or distribution of the fuel and/or additive compositions in which it is used.

In some embodiments the fuel compositions supplied to the engine contain a limited amount of nitrogen. In other embodiments the fuel compositions contain a limited amount of nitrogen where the nitrogen is basic nitrogen and/or amine nitrogen. The term "basic nitrogen" refers to nitrogen from basic nitrogen compounds, and does not apply to nitrogen from other sources. The term "amine nitrogen" refers nitrogen from compounds containing amine groups, which are one type of basic nitrogen compounds.

In some embodiments the fuel compositions described herein have a nitrogen content of less than 5,000 ppm, less than 3,000 ppm or even less than 1,000 ppm. In some embodiments the fuel compositions described herein have a basic and/or amine nitrogen content of less than 1,000 ppm, less than 500 ppm or even less than 100 ppm.

In some embodiments the fuel compositions described herein contain one or more nitrogen-containing fuel additives, for example nitrogen-containing fuel detergent, but at a concentration of less than 5,000 ppm, less than 3,000 ppm, less than 1,000 ppm, 500 ppm or even 100 ppm.

In some embodiments the fuel and/or additive compositions described herein are free of basic nitrogen and/or amine nitrogen-containing additives. In some embodiments the compositions are free of any nitrogen-containing dispersants and/or detergents. In still other embodiments the compositions contain no other fuel dispersants and/or detergents other than the substituted hydrocarbon additive described herein. In such embodiments the compositions may contain additional performance additives so long as the additives are not fuel dispersants and/or detergents, but are primarily present for another purpose.

The Fuel Compositions and Fuel Additive Compositions

The fuel compositions utilized in the invention comprise the fuel additive described herein and a liquid fuel, and is useful in fueling an internal combustion engine. The fuel compositions may also include one or more additional performance additives.

The fuel additive composition of the present invention comprises the fuel additive described herein and further comprises a solvent and/or a fuel and may further include one or more additional performance additives. These additive compositions, also known as additive concentrates and/or concentrates, may be used to prepare fuel compositions by adding the additive composition to a non-additized fuel.

The fuels suitable for use in the invention are not overly limited and include any commercially available fuels, and in some embodiments any commercially available diesel fuels and/or biofuels. Generally, suitable fuels are normally liquid at ambient conditions e.g., room temperature (20 to 30° C.). The liquid fuel can be a hydrocarbon fuel, a non-hydrocarbon fuel, or a mixture thereof.

The hydrocarbon fuel can be a petroleum distillate, including a gasoline as defined by ASTM specification D4814, or a diesel fuel, as defined by ASTM specification D975. In one embodiment the liquid fuel is a gasoline, and in another embodiment the liquid fuel is a non-leaded gasoline. In another embodiment the liquid fuel is a diesel fuel. The hydrocarbon fuel can be a hydrocarbon prepared by a gas to liquid process to include for example hydrocarbons prepared by a process such as the Fischer-Tropsch process. In some embodiments, the fuel used in the present invention is a diesel fuel, a biodiesel fuel, or combinations thereof.

In some embodiments, the fuels suitable for use in the present invention include any commercially available fuels, and in some embodiments any commercially available diesel fuels and/or biofuels. In other embodiments, the fuels suitable for use in the present invention include any commercially available fuels which are susceptible to metal pick up, and in some embodiments any commercially available diesel fuels and/or biofuels susceptible to metal pick up.

In still other embodiments, the fuels suitable for use in the present invention are any fuels, or any diesel fuels and/or biofuels, which are susceptible to pick up of oxidative metals to a level greater than 0.5 ppm when left in contact for an extended period of time with solid materials containing said metal. In some embodiments the exposure time involved is greater than 72 hours, greater than 48 hours, or greater than 24 hours.

In other embodiments the fuels used herein contain some amount of a metal, such as zinc, from whatever the source. In some embodiments the metal level in the fuel is from 0.1, 0.2 or 0.5 up to 10, 5 or 3 ppm. Metal content in fuel is generally known to contribute to injector fouling. The nitrogen-free detergents of the present invention can be useful for protecting against the negative impact low levels of metal in fuels may cause in an engine.

The non-hydrocarbon fuel can be an oxygen containing composition, often referred to as an oxygenate, which includes an alcohol, an ether, a ketone, an ester of a carboxylic acid, a nitroalkane, or a mixture thereof. The non-hydrocarbon fuel can include for example methanol, ethanol, methyl t-butyl ether, methyl ethyl ketone, transesterified oils and/or fats from plants and animals such as rapeseed methyl ester and soybean methyl ester, and nitromethane.

Mixtures of hydrocarbon and non-hydrocarbon fuels can include, for example, gasoline and methanol and/or ethanol, diesel fuel and ethanol, and diesel fuel and a transesterified plant oil such as rapeseed methyl ester and other bio-derived fuels. In one embodiment the liquid fuel is an emulsion of water in a hydrocarbon fuel, a non-hydrocarbon fuel, or a mixture thereof. In several embodiments of this invention the liquid fuel can have a sulphur content on a weight basis that is 5000 ppm or less, 1000 ppm or less, 300 ppm or less, 200 ppm or less, 30 ppm or less, or 10 ppm or less.

The liquid fuel of the invention is present in fuel compositions in a major amount that is generally greater than 95% by weight, and in other embodiments is present at greater than 97% by weight, greater than 99.5% by weight, or greater than 99.9% by weight. The deposit control additive of the present invention and/or the additional performance additives (when present), each considered separately or in combination, can be present in the fuel compositions at 0.01 to 5 percent by weight, and in other instances can be present from a minimum of 0.01, 0.1, 0.2 or even 0.5 to a maximum of 5, 3, 2, 1 or even 0.5 percent by weight.

The solvents suitable for use in the present invention include hydrocarbon solvents that provide for the additive composition's compatibility and/or homogeneity and to facilitate their handling and transfer and may include a fuel as described below. The solvent can be an aliphatic hydrocarbon, an aromatic hydrocarbon, an oxygen-containing composition, or a mixture thereof. In some embodiments the flash point of the solvent is generally about 25° C. or higher. In some embodiments the hydrocarbon solvent is an aromatic naphtha having a flash point above 62° C. or an aromatic naphtha having a flash point of 40° C. or a kerosene with a 16% aromatic content having a flash point above 62° C.

Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. Alcohols are usually aliphatic alcohols having about 2 to 10 carbon atoms and include ethanol, 1-propanol, isopropyl alcohol, 1-butanol, isobutyl alcohol, amyl alcohol, and 2-methyl-1-butanol.

The oxygen containing composition can include an alcohol, a ketone, an ester of a carboxylic acid, a glycol and/or a polyglycol, or a mixture thereof. The solvent in an embodiment of the invention will be substantially free of to free of sulphur having a sulphur content in several instances that is below 50 ppm, 25 ppm, below 18 ppm, below 10 ppm, below 8 ppm, below 4 ppm, or below 2 ppm.

The solvent and/or fuel can be present in the additive concentrate compositions at 0 to 99 percent by weight, and in other instances at 3 to 80 percent by weight, or 10 to 70 percent by weight. The deposit control additive of the present invention and/or the additional performance additives (when present), each considered separately or in combination, can be present in the additive concentrate composition at 0.01 to 100 percent by weight, and in other instances can be present from a minimum of 0.01, 0.1 or 0.5 to a maximum of 99.99, 95, 80 or even 75 percent by weight.

As allowed for by the ranges above, in one embodiment, the additive concentrate may comprise the fuel additive of the present invention and be substantially free of any additional solvent or fuel. In these embodiments the additive concentrate containing the fuel additive of the present invention is neat, in that it does not contain any additional solvent added to improve the material handling characteristics of the concentrate, such as its viscosity.

In several embodiments the fuel composition, fuel additive concentrate, and/or the fuel additive itself are substantially free of or free of at least one member selected from the group consisting of sulphur, phosphorus, sulfated ash, and combinations thereof, and in other embodiments the fuel composition contains less than 50 ppm, 20 ppm, less than 15 ppm, less than 10 ppm, or less than 1 ppm of any one or all of these members.

In one embodiment the additive concentrate composition, or a fuel composition containing the deposit control additive described herein, may be prepared by admixing the components of the composition at ambient to elevated temperatures, usually up to 60° C., until the composition is homogeneous.

The additional performance additives which may be included in the additive and/or fuel compositions of the invention are described below.

The Substituted Hydrocarbon Additive

The methods of the present invention utilize a deposit control additive comprising a substituted hydrocarbon with at least two carboxy functionalities in the form of acids or in the form an anhydride. In some embodiments the additive is a hydrocarbon substituted with at least two carboxy functionalities in the form of acids or anhydrides. In other embodiments the additive is a hydrocarbyl-substituted succinic acylating agent. In other embodiments the substituted hydrocarbon additive is a dimer acid compound. In still other embodiments the substituted hydrocarbon additive of the present invention includes a combination of two or more of the additives described in this section. Partial esters of the described materials are also contemplated by the invention and included herein.

The substituted hydrocarbon additives of the present invention, when used in the compositions and method described herein, reduce the amount of deposits that form inside the engine in which they are used and/or increase the amount of deposit removal inside said engines. In some embodiments the additive reduces the formation of and/or removes injector deposits. The additive may also improve the corrosion inhibition of the fuel and/or reduce the tendency of fuel compositions in which they are used to pick up metals.

The substituted hydrocarbon additives are generally considered to be nitrogen-free (they do not contain a nitrogen atom), however is it considered that small amounts of nitrogen may be present in the additive, and even a small number of nitrogen atoms may be present in some of the additive molecules. These small amounts of nitrogen may come from impurities found in the materials used to prepare the additives or other similar sources. The possibility of such small amounts of nitrogen has been contemplated and is considered to be within the scope of the invention. In some embodiments the substituted hydrocarbon additives of the invention contain less than 100 ppm of nitrogen and in other embodiments less than 50, 20 or even 10 ppm of nitrogen.

In still other embodiments the substituted hydrocarbon additives of the invention contain less than 5 ppm of nitrogen, less than 100 ppb, or are even truly free of measurable nitrogen.

The substituted hydrocarbon additives include dimer acids. In some embodiments, the dimer acid used in the present invention is derived from C10 to C20 fatty unsaturated carboxylic acids, C12 to C18 unsaturated acids, and/or C16 to C18 unsaturated acids.

The substituted hydrocarbon additives include succinic acids, halides, anhydrides and combination thereof. In some embodiments the agents are acids or anhydrides, and in other embodiments the agents are anhydrides, and in still other embodiments the agents are hydrolyzed anhydrides. The hydrocarbon of the substituted hydrocarbon additive and/or the primary hydrocarbyl group of the hydrocarbyl-substituted succinic acylating agent generally contains an average of at least about 8, or about 30, or about 35 up to about 350, or to about 200, or to about 100 carbon atoms. In one embodiment, the hydrocarbyl group is derived from a polyalkene. In other words the nitrogen free additive may be a hydrocarbyl substituted succinic acid, a hydrocarbyl substituted succinic anhydrides, a hydrolyzed hydrocarbyl substituted succinic anhydrides, or any combination thereof.

The polyalkene may be characterized by a Mn (number average molecular weight) of at least about 300. Generally, the polyalkene is characterized by an Mn of about 500, or about 700, or about 800, or even about 900 up to about 5000, or to about 2500, or to about 2000, or even to about 1500. In another embodiment n varies between about 300, or about 500, or about 700 up to about 1200 or to about 1300.

The polyalkenes include homopolymers and interpolymers of polymerizable olefin monomers of 2 to about 16 or to about 6, or to about 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the interpolymer is a homopolymer. An example of a polymer is a polybutene. In one instance about 50% of the polybutene is derived from isobutylene. The polyalkenes are prepared by conventional procedures.

In one embodiment, the hydrocarbyl groups are derived from polyalkenes having an n of at least about 1300, or about 1500, or about 1600 up to about 5000, or to about 3000, or to about 2500, or to about 2000, or to about 1800, and the Mw/Mn is from about 1.5 or about 1.8, or about 2, or to about 2.5 to about 3.6, or to about 3.2. In some embodiments the polyalkene is polyisobutylene with a molecular weight of 800 to 1200. The preparation and use of substituted hydrocarbons and/or substituted succinic acylating agents, wherein the hydrocarbon and/or substituent is derived from such polyalkenes are described in U.S. Pat. Nos. 3,172,892 and 4,234,435, the disclosures of which are hereby incorporated by reference.

In another embodiment, the substituted hydrocarbon and/or succinic acylating agents are prepared by reacting the above described polyalkene with an excess of maleic anhydride to provide substituted succinic acylating agents wherein the number of succinic groups for each equivalent weight of substituent group is at least 1.3, or to about 1.5, or to about 1.7, or to about 1.8. The maximum number generally will not exceed 4.5, or to about 2.5, or to about 2.1, or to about 2.0. The polyalkene here may be any of those described above.

In another embodiment, the hydrocarbon and/or hydrocarbyl group contains an average from about 8, or about 10, or about 12 up to about 40, or to about 30, or to about 24, or to about 20 carbon atoms. In one embodiment, the hydrocarbyl group contains an average from about 16 to about 18 carbon atoms. In another embodiment, the hydrocarbyl group is tetrapropenyl group. In one embodiment, the hydrocarbyl group is an alkenyl group.

The hydrocarbon and/or hydrocarbyl group may be derived from one or more olefins having from about 2 to about 40 carbon atoms or oligomers thereof. These olefins are preferably alpha-olefins (sometimes referred to as mono-1-olefins) or isomerized alpha-olefins. Examples of the alpha-olefins include ethylene, propylene, butylene, 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, etc. Commercially available alpha-olefin fractions that may be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. In one embodiment, the olefins are $C_{16}$ and $C_{16-18}$ alpha-olefins. Additionally, $C_{30}$+ alpha-olefin fractions can be used. In one embodiment, the olefin monomers include ethylene, propylene and 1-butene.

Isomerized alpha-olefins are alpha-olefins that have been converted to internal olefins. The isomerized alpha-olefins suitable for use herein are usually in the form of mixtures of internal olefins with some alpha-olefins present. The procedures for isomerizing alpha-olefins are well known to those in the art. Briefly these procedures involve contacting alpha-olefin with a cation exchange resin at a temperature in a range of about 80° to about 130° C. until the desired degree of isomerization is achieved. These procedures are described for example in U.S. Pat. No. 4,108,889 which is incorporated herein by reference.

The mono-olefins may be derived from the cracking of paraffin wax. The wax cracking process yields both even and odd number $C_{6-20}$ liquid olefins of which 85% to 90% are straight chain 1-olefins. The balance of the cracked wax olefins is made up of internal olefins, branched olefins, diolefins, aromatics and impurities. Distillation of the $C_{6-20}$ liquid olefins, obtained from the wax cracking process, yields fractions (e.g., $C_{15-18}$ alpha-olefins) which are useful in preparing the succinic acylating agents.

Other mono-olefins can be derived from the ethylene chain growth process. This process yields even numbered straight-chain 1-olefins from a controlled Ziegler polymerization. Other methods for preparing the mono-olefins include chlorination-dehydrochlorination of paraffin and catalytic dehydrogenation of paraffins.

The above procedures for the preparation of mono-olefins are well known to those of ordinary skill in the art and are described in detail under the heading "Olefins" in the *Encyclopedia of Chemical Technology*, Second Edition, Kirk and Othmer, Supplement, Pages 632,657, Interscience Publishers, Div. of John Wiley and Son, 1971, which is hereby incorporated by reference for its relevant disclosures pertaining to methods for preparing mono-olefins.

Succinic acylating agents are prepared by reacting the above-described olefins, isomerized olefins or oligomers thereof with unsaturated carboxylic acylating agents, such as itaconic, citraconic, or maleic acylating agents at a temperature of about 160°, or about 185° C. up to about 240° C., or to about 210° C. Maleic acylating agents are the preferred unsaturated acylating agents. The procedures for preparing the acylating agents are well known to those skilled in the art and have been described for example in U.S. Pat. No. 3,412,111; and Ben et al, "The Ene Reaction of Maleic Anhydride With Alkenes", J.C.S. Perkin II (1977), pages 535-537. These references are incorporated by reference for their disclosure of procedures for making the above acylating agents. In one embodiment, the alkenyl group is derived from oligomers of lower olefins, i.e., olefins containing from 2 to about 6, or about 4 carbon atoms. Examples of these olefins include ethylene, propylene and butylene.

The olefin, olefin oligomer, or polyalkene may be reacted with the carboxylic reagent such that there is at least one mole of carboxylic reagent for each mole of olefin, olefin oligomer, or polyalkene that reacts. Preferably, an excess of carboxylic reagent is used. In one embodiment, this excess is between about 5% to about 25%. In another embodiment, the excess is greater than 40%, or greater than 50%, and even greater than 70%.

The conditions, i.e., temperature, agitation, solvents, and the like, for forming the hydrocarbyl-substituted succinic acylating agent, are known to those in the art. Examples of patents describing various procedures for preparing useful acylating agents include U.S. Pat. No. 3,172,892 (Le Suer et al.); U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. 1,440,219. The disclosures of these patents are hereby incorporated by reference.

In some embodiments the substituted hydrocarbon additives and/or hydrocarbyl substituted succinic acylating agents suitable for use in the present invention contain di-acid functionality. In other embodiments, which may be used alone or in combination with the embodiments described above, the hydrocarbyl group of the hydrocarbyl substituted succinic acylating agent is derived from polyisobutylene and the di-acid functionality of the agent is provided by a carboxylic acid group, for example a hydrocarbyl substituted succinic acid.

In some embodiments the hydrocarbyl substituted acylating agent comprises one or more hydrocarbyl substituted succinic anhydride groups. In some embodiments the hydrocarbyl substituted acylating agent comprises one or more hydrolyzed hydrocarbyl substituted succinic anhydride groups.

In some embodiments the hydrocarbyl substituents of the acylating agents described above are derived from homopolymers and/or copolymers containing 2 to 10 carbon atoms. In some embodiments the hydrocarbyl substituents of any of the acylating agents described above are derived from polyisobutylene.

The deposit control additives of the present invention can be solids, semi-solids, or liquids (oils) depending on the particular alcohol(s) and/or amine(s) used in preparing them. For use as additives in oleaginous compositions including lubricating and fuel compositions the fuel additives are advantageously soluble and/or stably dispersible in such oleaginous compositions. Thus, for example, compositions intended for use in fuels are typically fuel-soluble and/or stably dispersible in a fuel in which they are to be used. The term "fuel-soluble" as used in this specification and appended claims does not necessarily mean that all the compositions in question are miscible or soluble in all proportions in all fuels. Rather, it is intended to mean that the composition is soluble in a fuel (hydrocarbon, non-hydrocarbon, mixtures, etc) in which it is intended to function to an extent which permits the solution to exhibit one or more of the desired properties. Similarly, it is not necessary that such "solutions" be true solutions in the strict physical or chemical sense. They may instead be micro-emulsions or colloidal dispersions which, for the purpose of this invention, exhibit properties sufficiently close to those of true solutions to be, for practical purposes, interchangeable with them within the context of this invention.

As previously indicated, the additives of this invention are useful as additives for fuels. The fuel additives of the present invention can be present in fuel compositions at 1 to 10,000 ppm (where ppm is calculated on a weight:weight basis). In additional embodiments, the fuel additive is present in fuel compositions in ranges with lower limits of 1, 3, 5, 10, 50, 100, 150 and 200 ppm and upper limits of 10,000, 7,500, 5,000, and 2,500 where any upper limit may be combined with any lower limit to provide a range for the fuel additive present in the fuel compositions.

In some embodiments the nitrogen-free fuel detergent additives of the invention have an Mn of at least about 300, 500, 700, 800 or even at least 900 and up to 5000, 2500, 2000 or even up to 1500. In another embodiment Mn varies between 300, or 500, or 700 up to 1200 or 1300.

It is contemplated that the additives of the present invention may form salts or other complexes and/or derivatives, when interacting with other components of the compositions in which they are used. Such forms of these additives are also part of the present invention and are include in the embodiment described herein. Some of the succinic acylating agents of the present invention and the processes for making them are disclosed in U.S. Pat. Nos. 5,739,356; 5,777,142; 5,786,490; 5,856,524; 6,020,500; and 6,114,547 which are hereby incorporated by reference. Other methods of making the hydrocarbyl substituted acylating agent can be found in U.S. Pat. Nos. 5,912,213; 5,851,966; and 5,885,944 which are hereby incorporated by reference. In some embodiments the succinic acylating agents of the present invention are prepared by the thermal process and/or chlorine free process only, as described in EP0355895 hereby incorporated by reference.

Additional Performance Additives

The additive compositions and fuel compositions of the present invention can further comprise one or more additional performance additives. Additional performance additives can be added to a fuel composition depending on several factors to include the type of internal combustion engine and the type of fuel being used in that engine, the quality of the fuel, and the service conditions under which the engine is being operated.

The additional performance additives can include: an additional fuel dispersant and/or detergent, a cetane improver, a petroleum dye and/or marker, an antioxidant, a lubricity improver, a corrosion inhibitor, a cold flow improver, a metal deactivator, a demulsifier, an antifoam agent, a drag reducing agent, or combinations thereof.

Suitable antioxidants include a hindered phenol or derivative thereof and/or a diarylamine or derivative thereof. Suitable detergent/dispersant additive include polyetheramines or nitrogen-containing detergents, including but not limited to PIB amine dispersants, quaternary salt dispersants, and succinimide dispersants. However, as noted above, in some embodiments the compositions described herein are free of basic nitrogen and/or amine nitrogen-containing compounds.

The additional performance additives may also include: a cold flow improver such as an esterified copolymer of maleic anhydride and styrene and/or a copolymer of ethylene and vinyl acetate; a foam inhibitor and/or antifoam agent such as a silicone fluid; a demulsifier such as a polyalkoxylated alcohol; a lubricity agent such as a fatty carboxylic acid; a metal deactivator such as an aromatic triazole or derivative thereof, including but not limited to benzotriazole; and/or a valve seat recession additive such as an alkali metal sulfosuccinate salt.

Suitable antifoams also include organic silicones such as polydimethyl siloxane, polyethylsiloxane, polydiethylsiloxane, polyacrylates and polymethacrylates, trimethyl-trifluoro-propylmethyl siloxane and the like.

The additional additives may also include a biocide; an antistatic agent, a deicer, a fluidizer such as a mineral oil and/or a poly(alpha-olefin) and/or a polyether, and a combustion improver such as an octane or cetane improver.

The additional performance additives also include diester, di-amide, ester-amide, and ester-imide friction modifiers prepared by reacting a dicarboxylic acid (such as tartaric acid) and/or a tricarboxylic acid (such as citric acid), with an amine and/or alcohol, optionally in the presence of a known esterification catalyst. These friction modifiers, often derived from tartaric acid, citric acid, or derivatives thereof, may be derived from amines and/or alcohols that are branched so that the friction modifier itself has significant amounts of branched hydrocarbyl groups present within it structure. Examples of a suitable branched alcohols used to prepare these friction modifiers include 2-ethylhexanol, isotridecanol, Guerbet alcohols, or mixtures thereof.

While the primary benefit of the invention is related to the described additives being free of nitrogen, they may of course still be used in combination with nitrogen-containing additives. In some embodiments the invention includes the presence of nitrogen-containing additives so long as the nitrogen delivered by such additives does not eliminate the benefit of the invention. In other embodiments the invention is essentially free of, or even free of, nitrogen-containing additives.

The additional performance additives may comprise a high TBN nitrogen containing dispersant, such as a succinimide dispersant, that is the condensation product of a hydrocarbyl-substituted succinic anhydride with a poly (alkyleneamine). Succinimide dispersants are very well known in the art of lubricant formulation. Such molecules are commonly derived from reaction of an alkenyl acylating agent with a polyamine, and a wide variety of linkages between the two moieties is possible including a simple imide structure as well as a variety of amides and quaternary ammonium salts. Succinimide dispersants are more fully described in U.S. Pat. Nos. 4,234,435 and 3,172,892. Such materials may also contain ester linkages or ester functionality.

Another class of nitrogen-containing dispersant is the Mannich bases. These are materials which are formed by the condensation of a higher molecular weight, alkyl substituted phenol, an alkylene polyamine, and an aldehyde such as formaldehyde. Such materials are described in more detail in U.S. Pat. No. 3,634,515.

Other nitrogen-containing dispersants include polymeric dispersant additives, which are generally hydrocarbon-based polymers which contain nitrogen-containing polar functionality to impart dispersancy characteristics to the polymer.

An amine is typically employed in preparing the high TBN nitrogen-containing dispersant. One or more poly (alkyleneamine)s may be used, and these may comprise one or more poly(ethyleneamine)s having 3 to 5 ethylene units and 4 to 6 nitrogens. Such materials include triethylenetetramine (TETA), tetraethylenepentamine (TEPA), and pentaethylenehexamine (PEHA). Such materials are typically commercially available as mixtures of various isomers containing a range number of ethylene units and nitrogen atoms, as well as a variety of isomeric structures, including various cyclic structures. The poly(alkyleneamine) may likewise comprise relatively higher molecular weight amines known in the industry as ethylene amine still bottoms.

The additional performance additives may comprise a quaternary salt comprising the reaction product of: (i) at least one compound selected from the group consisting of: (a) the condensation product of a hydrocarbyl-substituted acylating agent and a compound having an oxygen or nitrogen atom capable of condensing with said acylating agent and said condensation product further having a tertiary amino group; (b) a polyalkene-substituted amine having at least one tertiary amino group; and (c) a Mannich reaction product having a tertiary amino group, said Mannich reaction product being prepared from the reaction of a hydrocarbyl-substituted phenol, an aldehyde, and an amine; and (ii) a quaternizing agent suitable for converting the tertiary amino group of compound (i) to a quaternary nitrogen, wherein the quaternizing agent is selected from the group consisting of dialkyl sulfates, benzyl halides, hydrocarbyl substituted carbonates; hydrocarbyl epoxides in combination with an acid or mixtures thereof.

In one embodiment the quaternary salt comprises the reaction product of (i) at least one compound selected from the group consisting of: a polyalkene-substituted amine having at least one tertiary amino group and/or a Mannich reaction product having a tertiary amino group; and (ii) a quaternizing agent.

In another embodiment the quaternary salt comprises the reaction product of (i) the reaction product of a succinic anhydride and an amine; and (ii) a quaternizing agent. In such embodiments, the succinic anhydride may be derived from polyisobutylene and an anhydride, where the polyisobutylene has a number average molecular weight of about 800 to about 1600. In some embodiments the succinic anhydride is chlorine free.

In some embodiments, the hydrocarbyl substituted acylating agent of component (i)(a) described above is the reaction product of a long chain hydrocarbon, generally a polyolefin substituted with a monounsaturated carboxylic acid reactant such as (1) monounsaturated $C_4$ to $C_{10}$ dicarboxylic acid such as fumaric acid, itaconic acid, maleic acid; (2) derivatives of (1) such as anhydrides or $C_1$ to $C_5$ alcohol derived mono- or di-esters of (1); (3) monounsaturated $C_3$ to $C_{10}$ monocarboxylic acid such as acrylic acid and methacrylic acid; or (4) derivatives of (3) such as $C_1$ to $C_5$ alcohol derived esters of (3) with any compound containing an olefinic bond represented by the general formula:

$$(R^1)(R^1)C{=}C(R^1)(CH(R^1)(R^1)) \quad (I)$$

wherein each $R^1$ is independently hydrogen or a hydrocarbyl group.

Olefin polymers for reaction with the monounsaturated carboxylic acids can include polymers comprising a major molar amount of $C_2$ to $C_{20}$, e.g. $C_2$ to $C_5$ monoolefin. Such olefins include ethylene, propylene, butylene, isobutylene, pentene, octene-1, or styrene. The polymers can be homopolymers such as polyisobutylene, as well as copolymers of two or more of such olefins such as copolymers of; ethylene and propylene; butylene and isobutylene; propylene and isobutylene. Other copolymers include those in which a minor molar amount of the copolymer monomers e.g., 1 to 10 mole % is a $C_4$ to $C_{18}$ diolefin, e.g., a copolymer of isobutylene and butadiene; or a copolymer of ethylene, propylene and 1,4-hexadiene.

In one embodiment, at least one R of formula (I) is derived from polybutene, that is, polymers of $C_4$ olefins, including 1-butene, 2-butene and isobutylene. $C_4$ polymers can include polyisobutylene. In another embodiment, at least one R of formula (I) is derived from ethylene-alpha olefin polymers, including ethylene-propylene-diene polymers. Ethylene-alpha olefin copolymers and ethylene-lower olefin-diene terpolymers are described in numerous patent documents, including European patent publication EP0279863 and the following U.S. Pat. Nos. 3,598,738; 4,026,809; 4,032,700; 4,137,185; 4,156,061; 4,320,019; 4,357,250; 4,658,078; 4,668,834; 4,937,299; 5,324,800 each of which are incorporated herein by reference for relevant disclosures of these ethylene based polymers.

In another embodiment, the olefinic bonds of formula (I) are predominantly vinylidene groups, represented by the following formulas:

$$—(H)C{=}C(R^2)(R^2) \quad (II)$$

wherein $R^2$ is a hydrocarbyl group, and in some embodiments both $R^2$ groups are methyl groups, and $$—(H)(R^3)C(C(CH_3){=}CH_2) \quad (III)$$

wherein $R^3$ is a hydrocarbyl group.

In one embodiment, the vinylidene content of formula (I) can comprise at least about 30 mole % vinylidene groups, at least about 50 mole % vinylidene groups, or at least about 70 mole % vinylidene groups. Such material and methods for preparing them are described in U.S. Pat. Nos. 5,071,919; 5,137,978; 5,137,980; 5,286,823, 5,408,018, 6,562,913, 6,683,138, 7,037,999 and U.S. Publication Nos. 20040176552A1, 20050137363 and 20060079652A1, which are expressly incorporated herein by reference, such products are commercially available by BASF, under the tradename GLISSOPAL® and by Texas Petrochemicals LP, under the tradename TPC 1105™ and TPC 595™.

Methods of making hydrocarbyl substituted acylating agents from the reaction of the monounsaturated carboxylic acid reactant and the compound of formula (I) are well know in the art and disclosed in the following patents: U.S. Pat. Nos. 3,361,673 and 3,401,118 to cause a thermal "ene" reaction to take place; U.S. Pat. Nos. 3,087,436; 3,172,892; 3,272,746, 3,215,707; 3,231,587; 3,912,764; 4,110,349; 4,234,435; 6,077,909; 6,165,235 and are hereby incorporated by reference.

In another embodiment, the hydrocarbyl substituted acylating agent can be made from the reaction of at least one carboxylic reactant represented by the following formulas:

$$(R^4C(O)(R^5)_nC(O))R^4 \quad (IV)$$

and

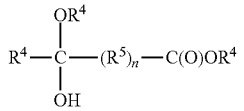

(V)

wherein each $R^4$ is independently H or a hydrocarbyl group, and each $R^5$ is a divalent hydrocarbylene group and n is 0 or 1 with any compound containing an olefin bond as represented by formula (I). Compounds and the processes for making these compounds are disclosed in U.S. Pat. Nos. 5,739,356; 5,777,142; 5,786,490; 5,856,524; 6,020,500; and 6,114,547 which are hereby incorporated by reference.

Other methods of making the hydrocarbyl substituted acylating agent can be found in the following reference, U.S. Pat. Nos. 5,912,213; 5,851,966; and 5,885,944 which are hereby incorporated by reference.

The compound having an oxygen or nitrogen atom capable of condensing with the acylating agent and further having a tertiary amino group can be represented by the following formulas:

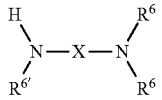

(VI)

wherein X is a alkylene group containing about 1 to about 4 carbon atoms; and wherein each $R^6$ is independently a hydrocarbyl group, and $R^{6'}$ can be hydrogen or a hydrocarbyl group.

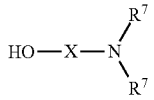

(VII)

wherein X is a alkylene group containing about 1 to about 4 carbon atoms; and wherein each $R^7$ is independently a hydrocarbyl group.

Examples of the nitrogen or oxygen contain compounds capable of condensing with the acylating agent and further having a tertiary amino group can include but are not limited to: dimethylaminopropylamine, N,N-dimethylaminopropylamine, N,N-diethyl-aminopropylamine, N,N-dimethylaminoethylamine or mixtures thereof. In addition, nitrogen or oxygen contain compounds which may be alkylated to contain a tertiary amino group may also used. Examples of the nitrogen or oxygen contain compounds capable of condensing with the acylating agent after being alkylated to having a tertiary amino group can include but are not limited to: ethylenediamine, 1,2-propylenediamine, 1,3-propylene diamine, the isomeric butylenediamines, pentanediamines, hexanediamines, heptanediamines, diethylenetriamine, dipropylenetriamine, dibutylenetriamine, triethylenetetraamine, tetraethylenepentaamine, pentaethylenehexaamine, hexamethylenetetramine, and bis(hexamethylene)triamine, the diaminobenzenes, the diaminopyridines or mixtures thereof.

The nitrogen or oxygen containing compounds capable of condensing with the acylating agent and further having a tertiary amino group can further include aminoalkyl substituted heterocyclic compounds such as 1-(3-aminopropyl) imidazole and 4-(3-aminopropyl)morpholine, 1-(2-aminoethyl)piperidine, 3,3-di amino-N-methyldipropylamine, 3'3-aminobis(N,N-dimethylpropylamine). Another type of nitrogen or oxygen containing compounds capable of condensing with the acylating agent and having a tertiary amino group include alkanolamines including but not limited to triethanolamine, N,N-dimethylaminopropanol, N,N-diethylaminopropanol, N,N-diethylaminobutanol, N,N,N-tris(hydroxyethyl)amine, or mixtures thereof.

Examples of quaternary ammonium salt and methods for preparing the same are described in the following patents, which are hereby incorporated by reference, U.S. Pat. No. 4,253,980, U.S. Pat. No. 3,778,371, U.S. Pat. No. 4,171,959, U.S. Pat. No. 4,326,973, U.S. Pat. No. 4,338,206, and U.S. Pat. No. 5,254,138.

The additional performance additives can each be added directly to the additive and/or the fuel compositions of the present invention, but they are generally mixed with the fuel additive to form an additive composition, or concentrate, which is then mixed with fuel to result in a fuel composition. The additive concentrate compositions are described in more detail above.

In some embodiments, these additional performance additives described above may be the cause and/or a contributing factor to the propensity of a fuel to pick up oxidative metal in the fuel compositions in which they are used. In other embodiments, the additives described above may have no impact on the metal pick-up properties of the fuel composition in which they are used. In either case, the additive compositions and methods of the present invention can counter the potential effect of these additives and reduce the tendency of fuel compositions to pick-up metals, whether that tendency is caused, exacerbated by, or not significantly changes by, the additional performance additives described above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. In addition the acylating agents and/or substituted hydrocarbon additives of the present invention may form salts or other complexes and/or derivatives, when interacting with other components of the compositions in which they are used. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples, which sets forth particularly advantageous embodiments. While the examples are provided to illustrate the present invention, they are not intended to limit it.

Example Set 1

A set of examples is prepared and tested in the XUD9 nozzle coking test. The test uses a 1.9 L 4-cylinder Peugeot XUD 9 engine run at 3000 RPM under a load of 58 Nm for 6 hours. At the start of the test new nozzles are flowed with air and measurements are taken at lift points of 0.1 mm. The nozzles are reassembled on the engine which is then warmed up to test conditions and then run for 6 hours. The nozzles are then reflowed and compared to the initial flow rate. While there is no specified pass/fail limit, a result of 15% remaining injector flow at the 0.1 mm measurement is generally considered to be a minimum passing outcome. Each example in Example Set 1 is run in a conventional sulfur free diesel fuel. The formulation of the examples and the results obtained are summarized in the table below:

TABLE 1

Example Set 1, XUD9 Results

| Example | Additive | Treat Rate | Remaining Flow |
|---|---|---|---|
| 1-A | None | 0 | 22% |
| 1-B | Nitrogen-Containing Detergent[1] | 39 ppm | 29% |
| 1-C | Nitrogen-Free Detergent[2] | 128 ppm | 32% |

[1]The nitrogen-containing detergent is a succinimide dispersant derived from 1000 number average molecule weight (Mn) polyisobutylene.
[2]The nitrogen-free detergent is a polyolefin acid derived from 1000 number average molecule weight (Mn) polyisobutylene and a dicarboxylic acid.

The results in Example Set 1 show that the nitrogen-free detergents described above, and the methods of using thereof, provide some level of detergency in port injection engines such as the XUD9 as demonstrated by the higher reaming percent flow results in the XUD9 engine test. Specifically, the nitrogen-free detergent provides detergency compared to the non-additized base fuel. Further the nitrogen-free detergent provides at least comparable detergency compared to a corresponding nitrogen-containing detergent, albeit at a higher treat rate. These results are unexpected given that nitrogen-containing additives are generally considered a requirement for fuel detergency.

Example Set 2

A set of examples is prepared and tested in the CEC DW10 diesel fuel injector fouling test, designated SG-F-098. The test uses a 2.0 L, 4-cylinder Peugeot DW10 direct injection turbocharged, common rail engine. The test procedure includes a 16 hour bedding-in period for the new injectors, followed by an 8 hour cyclic running period then a 4 hour soak period, with this sequence repeated for 32 hours of running time. The test reports engine power loss after 32 hours of engine running time. Lower engine loss values indicate lower levels of injector fouling. Lower levels of injector fouling indicate better detergency. Examples 2-A, 2-B and 2-C are run in a sulfur free diesel fuel. A small amount of zinc (2 ppm) is also added to each sample. Examples 2-D and 2-E are run in a blend 90:10 blend of the diesel fuel used in Examples 2-A, 2-B and 2-C with additional biodiesel. No zinc is added to these examples. The formulation of the examples and the results obtained are summarized in the table below:

TABLE 2

Example Set 2, DW10 Results

| Example | Additive | Treat Rate | Power Loss at 32 hrs |
|---|---|---|---|
| 2-A | None | 0 | −10.22 |
| 2-B | Nitrogen-Free Detergent[1] | 61 ppm | −0.89 |
| 2-C | Nitrogen-Containing Detergent[2] | 62 ppm | −7.04 |
| 2-D | None | 0 | −6.61 |
| 2-E | Nitrogen-Free Detergent[1] | 68 ppm | 0.51 |

[1]The nitrogen-free detergent is a polyolefin acid derived from 1000 number average molecule weight (Mn) polyisobutylene and a dicarboxylic acid.
[2]The nitrogen-containing detergent is a succinimide dispersant derived from 1000 number average molecule weight (Mn) polyisobutylene.

The results in Example Set 2 show that the nitrogen-free detergents described above, and the methods of using thereof, provide significant detergency in direct injection engines demonstrated by the reduced power loss seen in the DW10 engine test. Specifically, the nitrogen-free detergent provides significantly improved detergency compared to the non-additized base fuel as well as the fuel additized with a corresponding nitrogen-containing detergent, even at the same treat rate. Furthermore, the benefit is also seen in examples 2-E in a higher-biodiesel content fuel. These results are unexpected given that nitrogen-containing additives are generally considered a requirement for fuel detergency and the significant improvement the nitrogen-free additive provided.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicates all percent values and ppm values herein are weight percent values and/or calculated on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What we claim:

1. A method of providing improved detergency in the fuel system of a direct injection diesel engine wherein the method comprises the steps of:

I. adding to the fuel composition a nitrogen-free additive comprising a polyolefin acid derived from polyisobutylene and a dicarboxylic acid II. supplying said fuel composition to an internal combustion engine wherein the engine operates with a fuel injector pressure of equal to or greater than 160 MPa.

2. The method of claim 1 wherein the method provides a combination of improved detergency and improved corrosion inhibition.

3. The method of claim 1 wherein the polyisobutylene has a molecular weight of 800 to 1200.

4. The method of claim 1 wherein the fuel composition further comprises at least one of an additional fuel detergent and/or dispersant, a cetane improver, a petroleum dye and/or marker, an antioxidant, a lubricity improver, a corrosion inhibitor, a cold flow improver, a metal deactivator, a demulsifier, an antifoam agent, a drag reducing agent, or combinations thereof.

5. The method of claim 4, wherein said additional detergent is not a nitrogen-containing dispersant and/or detergent.

6. The method of claim 1, wherein the fuel composition further comprises at least one of a cetane improver, a petroleum dye and/or marker, an antioxidant, a lubricity improver, a corrosion inhibitor, a cold flow improver, a metal deactivator, a demulsifier, an antifoam agent, a drag reducing agent, or combinations thereof and does not contain other fuel dispersants and/or detergents other than said substituted hydrocarbon.

7. The method of claim 1, wherein the fuel composition comprises diesel fuel, biodiesel or combinations thereof.

8. The method of claim 1, wherein the engine is a high pressure direct injection diesel engine and the method results in the reduction of injector deposits.

9. The method of claim 4, wherein said fuel composition comprises less than 1,000 ppm of basic nitrogen and/or amine nitrogen containing additional fuel detergent and/or dispersant.

* * * * *